US005819336A

United States Patent [19]

Gilliam et al.

[11] Patent Number: 5,819,336

[45] Date of Patent: Oct. 13, 1998

[54] CONTROL SYSTEM FOR AUTOMATIC CONTROL OF A WATER RINSING SYSTEM

[75] Inventors: Danny W. Gilliam; Wade C. Patterson, both of Huntsville, Ala.

[73] Assignee: Integrated Technology Systems, Inc., Madison, Ala.

[21] Appl. No.: 368,026

[22] Filed: Jan. 3, 1995

[51] Int. Cl.[6] ..... E03C 1/05

[52] U.S. Cl. ..... 4/623; 4/304; 4/DIG. 3

[58] Field of Search ..... 4/304, 623, DIG. 3

[56] References Cited

U.S. PATENT DOCUMENTS

| | | | |
|---|---|---|---|
| 5,133,095 | 7/1992 | Shiba et al. | 4/304 X |
| 5,169,118 | 12/1992 | Whiteside | 4/623 X |
| 5,251,872 | 10/1993 | Kodaira | 4/304 X |

*Primary Examiner*—Robert M. Fetsuga
*Attorney, Agent, or Firm*—Harold W. Hilton; John C. Garvin, Jr.

[57] ABSTRACT

Apparatus and method for automatically controlling on-off operation of a battery-driven water rinsing system including a water supply system having electrically actuated actuation means for actuation of the water supply system to cause water flow therefrom. The on-off operation is responsive to approach and withdrawal of a user of the water rinsing system. A control circuit including an infrared transmitter, an infrared receiver, and control means is provided. The transmitter transmits infrared energy to a user in the vicinity of the water rinsing system for reflection from the user to an infrared receiver which transmits electric signals to the control circuit and control means for controlling actuation of the water supply system. A visible light sensor is provided for generating an electrical current responsive to the presence of the user, and this generated current is disposed for energizing the control circuit.

16 Claims, 6 Drawing Sheets

CONTROL SYSTEM FOR AUTOMATIC CONTROL OF A WATER RINSING SYSTEM

FIELD OF THE INVENTION

This invention relates generally to automatic operation of a water rinsing system and more particularly to automatic on-off control for a battery-operated water rinsing system having means for prolonging the life of the battery or batteries.

BACKGROUND OF THE INVENTION

Apparatus and method of the present invention combine both visible and infrared light to detect the presence of objects in front and near a water rinsing system. Electronic circuitry is provided to check for object presence on a constant interval of ⅛ second. At the start of the interval, the electronics processes sensor data. When the processing is finished, the significant power consuming sections of the electronics are placed in low power mode for the remaining time in the interval. The entire unit is operated from two D-cell batteries, and the electronics are controlled by an eight-bit microcontroller.

A photocell is used to detect visible light in front of the water rinsing device, and the photocell detects the shadow of people that move in front of the device. When a shadow is present, an infrared test is performed to determine if an individual is located in a predetermined position relative to the water rinsing device. If both conditions are true, the water rinsing system is turned to the on position. By only using the infrared test when a person is present, power is saved, which increases battery life. The system is turned off when the individual moves from the predetermined position. As long as a person remains in front of the device, the infrared test is performed once during every interval.

Automatically operable water supply devices are well known in the art, and such automatic water supply device typically include power sources which are either AC or battery-operated. Some typically automatic water supply apparatuses are set forth in the following U.S. Pat. No. 4,742,583 for "Water Supply Control Apparatus," issued May 10, 1988, to Takao Yoshida et al.; U.S. Pat. No. 4,826,129 for "Structure of Faucet For Automatic Water Supply and Stoppage, " issued May 2, 1989; U.S. Pat. No. 4,916,613 for "Remote Low Power Indicator For Battery Driven Apparatus," issued Apr. 10, 1990, to Jurgen Lange et al.; U.S. Pat. No. 5,060,323 for "Modular System For Automatic Operation of a Water Faucet," issued Oct. 29, 1991, to Daniel C. Shaw; U.S. Pat. No. 5,063,955 for "Method of Driving an Automatic On-Off Valve For a Water Passageway," issued Nov. 12, 1991, to Shigeru Sakakibara; and U.S. Pat. No. 5,074,520 for "Method of and System For Supplying Electric Power To Automatic Water Discharge Apparatus," issued Jul. 28, 1992. In each of the above-identified U.S. patents, the water supply devices include an electrical power source wherein an electrical signal must be continuously supplied. Such power demands in battery-operated systems result in the requirement for frequent replacement of batteries. The control system of the present invention overcomes such disadvantages.

SUMMARY OF THE INVENTION

In accordance with an aspect of the present invention, an automatic faucet, urinal, commode, water fountain, or the like is provided in which the water supply valve thereof is controlled automatically by signals produced by both visible and infrared light sensors. The faucet, urinal, commode, water fountain, or other water rinsing devices which are to be automatically operable are provided with a visible light sensor and an infrared light sensor/detector. The visible sensor (photocell) measures the visible light which is thereon and generates a signal inversely proportional to the light intensity or proportional to the shadow intensity of an individual adjacent to the water rinsing device (faucet, urinal, etc.). A control system is provided which includes a controller which reads the visible light sensor every ⅛ second; and, if a noticeable presence (shadow) is present, the controller is energized by the visible light sensor and starts reading the infrared sensor every ⅛ second. When the individual's presence is at a predetermined position relative to the infrared sensor, the controller detects the increase in infrared reflection off the individual and causes the electronic system to actuate a solenoid valve to cause water to flow to the water rinsing device. Water flow continues as long as the individual remains at the predetermined position relative to the water rinsing device. When the individual is no longer at this predetermined position relative to the water rinsing device, the water flow is terminated after a predetermined delay. The two-sensor approach (visible and infrared) extends the battery life by eliminating the continuous use of the infrared sensor.

It is, therefore, an object of the present invention to provide an automatic water rinsing system.

It is another object of the present invention to provide such a water rinsing system which is battery operable.

It is still another object of the present invention is to provide a means for extending the life of the battery to eliminate frequent requirements for changing the battery power source.

It is yet another object of the present invention to extend the life of the battery by operating the battery only during the time that water is demanded by the water rinsing system.

It is still yet another object of the present invention to provide such a water rinsing system with means to periodically check, at predetermined intervals, to determine when such operational power is required.

DESCRIPTION OF THE PREFERRED EMBODIMENT

Figure 1:
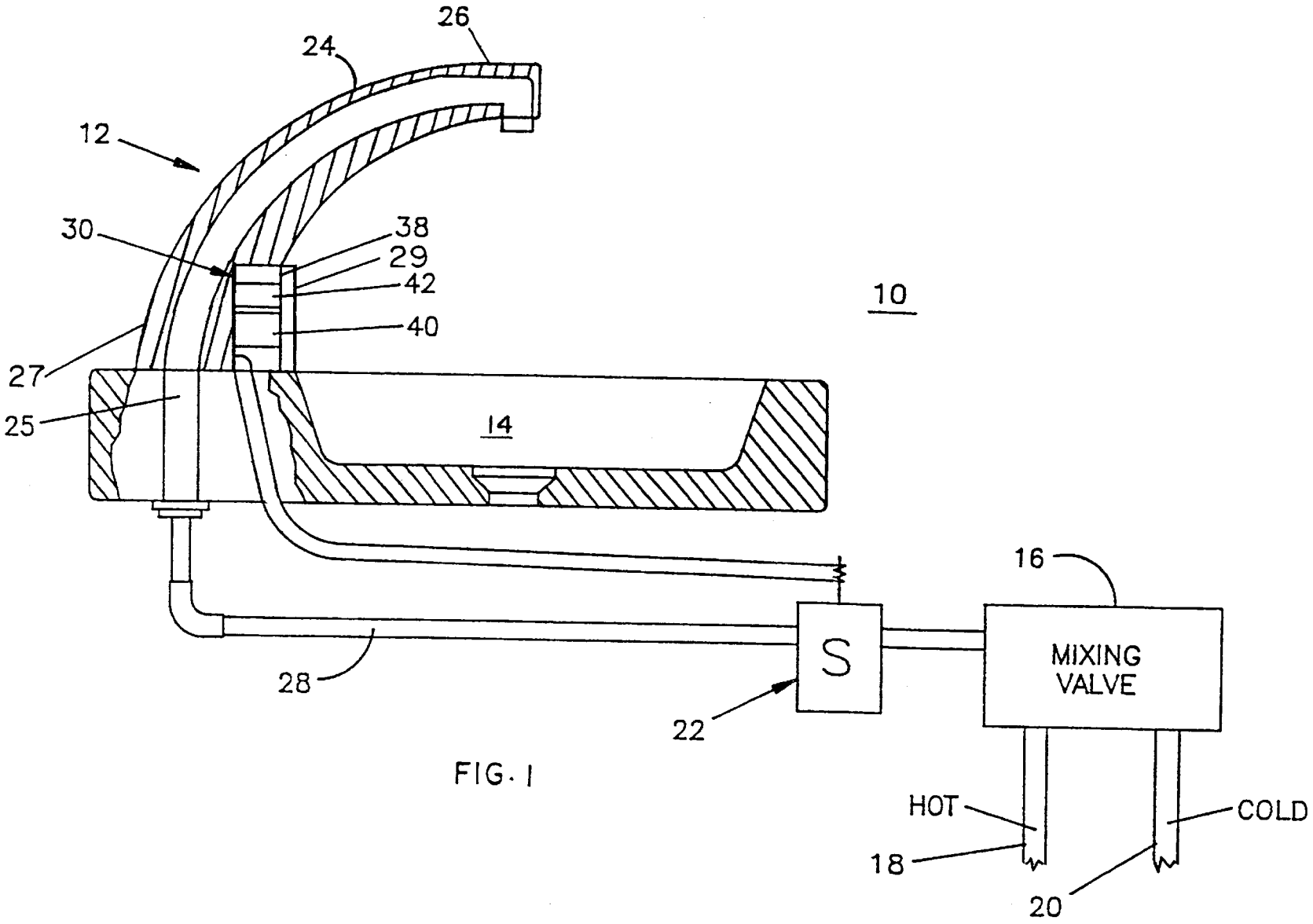
FIG. 1 is an elevational diagrammatic view of a faucet utilizing the principles of the present invention.

FIG. 1 diagrammatically illustrates a water rinsing system 10 as including a faucet 12 and a sink 14 for receiving water from faucet 12. Faucet 12 is flow connected to a mixing valve 16 which is flow connected to a source of hot and cold water 18 and 20. A solenoid valve 22 is connected to the downstream side of the mixing valve 16 for on-off control of water flow therefrom. Faucet 12 is shown to be provided with an extending arm portion 24 and a base portion 27. Arm portion 24 houses a water passage 26 which connects to a passage 25 of sink 14 which communicates with the mixing valve 16 by a pipe 28. Base portion 27 houses an electronic circuit board 30 on which the components (described hereinbelow) of the automatic electronic control system of the present invention is mounted. Base portion 27 further serves as a mount for a lens 29 which encloses a sensing system for reasons explained hereinbelow.

Figure 2:
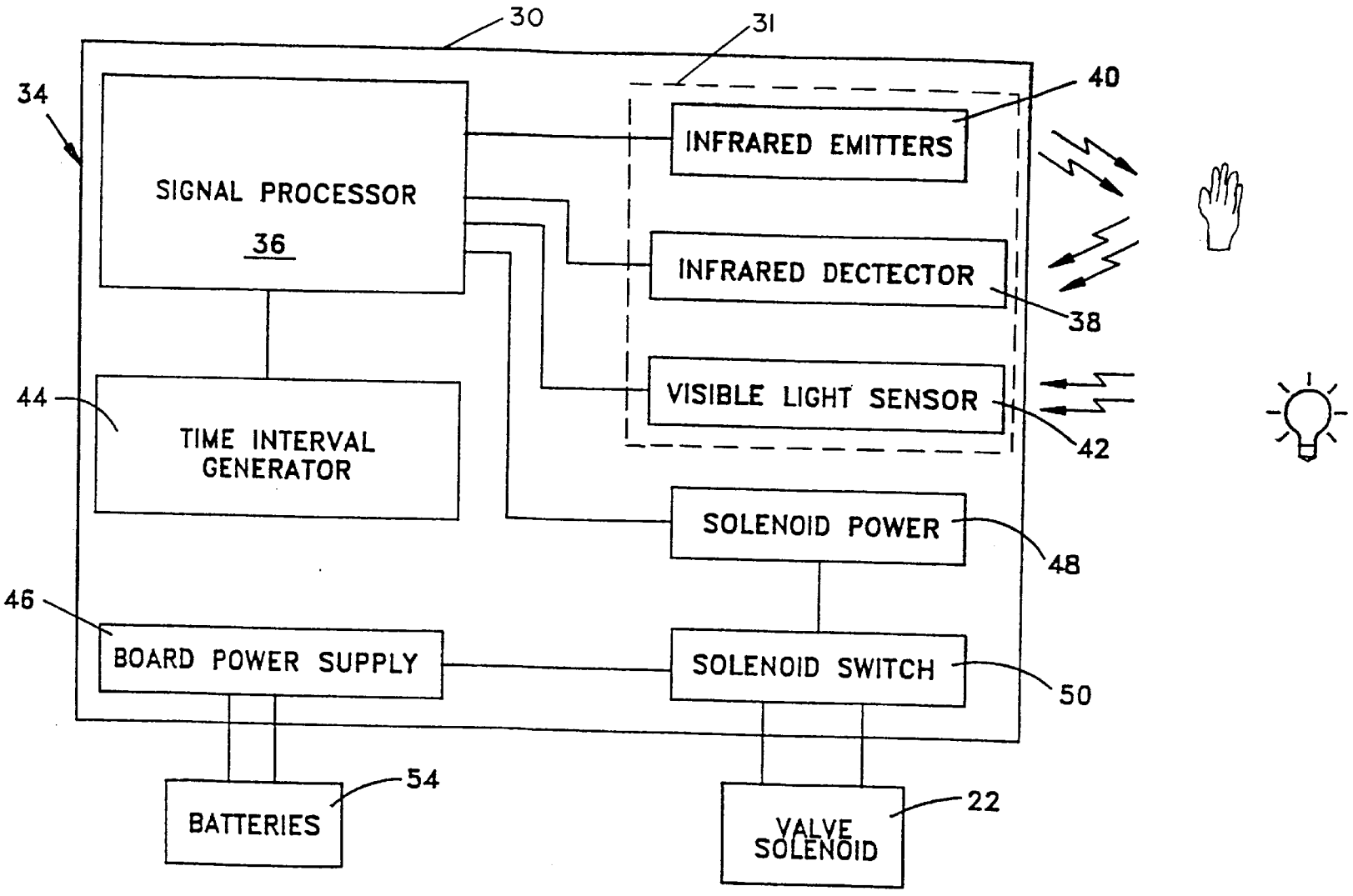
FIG. 2 is a block diagram generally illustrating the control system for the apparatus of the present invention.

As seen in FIGS. 1 and 2, the control system 34 of the present invention is shown mounted on a printed circuit board 30 and includes a microcontroller (signal processor) 36, and the sensing system 31 which includes an infrared detector 38, an infrared transmitter 40, and a visible light sensor 42. The control system also includes a time interval generator 44, a board power supply 46, a 12-volt solenoid power supply (charge pump) 48, and a solenoid switch 50 for actuation of solenoid valve 22. A pair of D-cell batteries 54 are provided to provide electrical power to the components on the circuit board.

Figure 3:
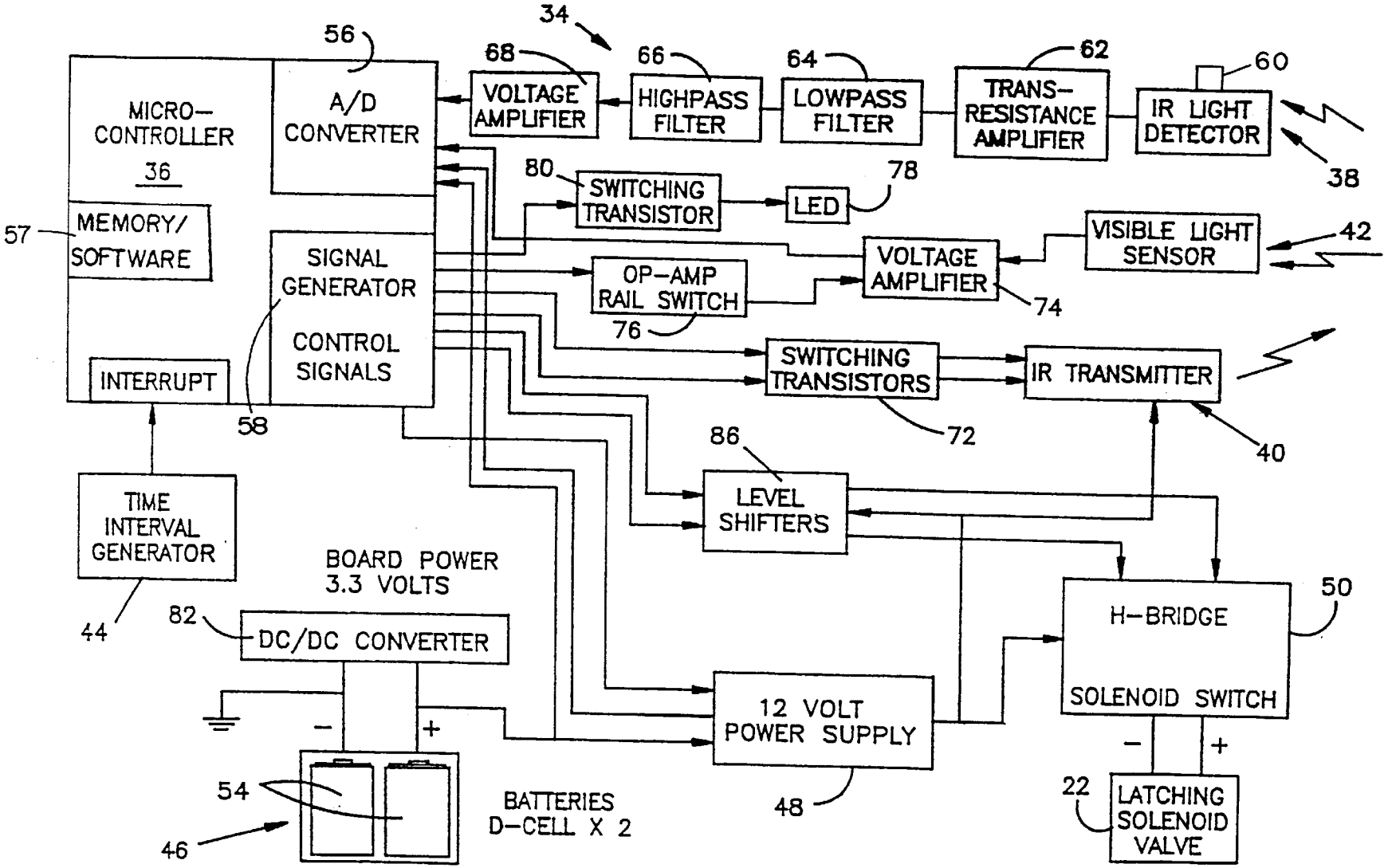
FIG. 3 is a block circuit diagram illustrating specific components of the apparatus of the present invention.

As more clearly shown in FIG. 3, microcontroller 36 includes an A/D converter 56 and a signal generator 58 for generating control signals and a memory/software section 57 which includes the different software used in controlling both faucet and urinal operations as set forth herein. Microcontroller 36 makes all the decisions with respect to water supplying operation. It measures the visible light level and decides when to activate the infrared sensor. It activates the infrared sensor by pulsing the infrared (IR) LEDs and then measuring the amount of reflected infrared light. Microcontroller 36 controls the state of the solenoid, and it regulates the onboard 12-volt supply. Microcontroller 36 also monitors the voltage level of the batteries via the A/D converter, and it will shut down when weak batteries are detected. Such microcontrollers are well known in the art. One typical microcontroller is manufactured by Motorola and identified by Model No. MC68HC705P9DW. Software for this particular microprocessor is written in the assembly language, although other codes and other microprocessors may be resorted to, if desired.

The microcontroller has a stop mode in which the chip consumes significantly less power than in the normal run mode. Upon entering either day or night mode, the software places the microcontroller in the stop mode. To get out of stop mode, an external interrupt must be issued to the microcontroller.

When the microcontroller leaves stop mode, the faucet software it is executing reads the photocell by performing an A/D conversion on the photocell amplifier output. If a shadow is present, the IR detector is read by performing an A/D conversion on an IR detector amplifier output (described hereinbelow). The photocell is read every interval (⅛ second). If the IR test is being performed, it is also read every interval.

Night (stop) mode is entered when the ambient light level is so low that a shadow cannot be detected. In night mode, the IR test is turned off and the faucet cannot be activated. There is an emergency night service mode that can be activated by shining a flashlight on the photocell for at least two seconds. In night service mode, the IR test is performed every interval for three minutes. If hands are detected during the three minutes, the faucet is operated in the same manner as in the day mode. At the end of the three minutes, night mode is re-entered. If the ambient light returns to an acceptable level during night mode or night service mode, day mode is re-entered.

Circuitry for infrared detector 38 (FIG. 3) is shown to consist of a photodiode 60, a transresistance amplifier (current to voltage converter) 62, a lowpass filter 64, a highpass filter 66, and a voltage amplifier 68. Photodiode 60 converts the incident IR light into current, which is then amplified by transresistance amplifier 62. Due to the extremely large gain needed in the transresistance amplifier, lowpass filter 64 is needed to stabilize the amplifier. The signal is then highpass filtered in filter 66 to remove the DC component and 120 Hz IR noise that is present in the ambient infrared light source. The signal is amplified by amplifier 68, again to obtain suitable resolution for microcontroller A/D converter 56.

Circuitry for infrared transmitter 40 consists of two IR LEDs which are powered by the onboard 12-volt supply 48. The LEDs are switched by microcontroller 36 through two Darlington transistors 72.

Visible light sensor 42 consists of a photocell in series with a resistor (not shown). The output from this voltage divider is amplified by amplifier 74 to obtain suitable resolution for the microcontroller's A/D converter 56. An OP-amp rail switch 76 is also connected to the input of this amplifier 74. This switch allows the microcontroller to measure the maximum voltage that the OP-amps 76 can produce. The maximum value is needed to detect environment errors via the A/D converter 56.

A visible LED 78 is used to communicate the internal status of the faucet to the user or maintenance personnel. The LED flashes to indicate when the solenoid is on (water should be running), when the battery is weak, and when an internal error has occurred. The LED flashes differently for each condition and is connected to signal generator 58 through a switching transistor 80.

Time interval generator 44 issues an interrupt to microcontroller 36 every ⅛ second, and this is the interval for which the visible and IR sensors are checked. When the microprocessor finishes its processing for the interval, it enters a low power sleep (night) mode. The next interrupt wakes the microprocessor, and the processing for the current interval is performed. This cycle is repeated endlessly for both day and night modes as long as the unit is operating normally. Such time interval generators are well known in the art. One such time interval generator is manufactured by Motorola and identified by Model No. MC14536BDW and includes a programmable IC to issue the interrupt to the microcontroller. The part is configured to generate a square wave at the frequency of 8 Hertz and has an on-board oscillator whose frequency is set by external sources.

A DC/DC converter 82 is provided to generator a constant 3.3 volts to the electronics during the usable life of the two series configured D-cell batteries. DC/DC converter 82 will operate until the battery voltage drops below 1.8 volts, at which time the faucet will shut down.

Twelve-volt power supply 48 is defined as a charge pump and is a DC/DC converter as well. Its purpose is to keep an aluminum capacitor (not shown) charged to 12 volts. The circuit is regulated by microcontroller 36, which monitors the voltage with its A/D converter 56 and drives the circuit with its on-chip PWM. The 12-volt supply is used to activate and deactivate the solenoid and provide high current pulses to the IR emitters. Such DC/DC converters are well known in the art.

It is to be understood that the microcontroller used herein has four A/D input channels. The first channel is used by the programmable time interval generator to issue the interrupt to the microcontroller, the second channel is used to perform an A/D conversion on the photocell amplified output after the microcontroller leaves the stop mode, the third channel is used to measure the battery voltage (which is done every interval), and the fourth channel is used to measure the 12-volt power supply.

Solenoid switch 50 consists of two n-channel MOSFETs and two p-channel MOSFETs in an H-bridge circuit configuration. This allows a two-wire latching solenoid 22 to be used instead of a three-wire solenoid. The H-bridge 84 places a positive voltage across the solenoid for activation and a negative voltage for deactivation. In either case, the voltage is only applied as a pulse whose width is set by microcontroller 36. The microcontroller includes pulse shaping circuitry to shape the pulse, as is well known in the art. At all other times, both terminals of the solenoid are held at ground potential. The p-channel MOSFETs cannot be driven directly from the microcontroller; thus, level shifters 86 are used to provide the 12-volt logic-high that is needed.

Water flow is controlled by latching solenoid valve 22 which consists of a water inlet, a water outlet, a valve seat, and a rubber membrane. The solenoid consists of a coil, a magnet, and a spring-loaded plunger.

The latching solenoid only requires a voltage pulse of fixed duration and magnitude to change the plunger's position, as opposed to a non-latching solenoid, which requires a continuous voltage to be applied to the solenoid to hold the plunger in the "on" position and no voltage at all to put the plunger in the "off" position. In a latching solenoid, the voltage pulse applied to the coil accelerates the plunger toward the magnet. When the plunger reaches the end of travel, the voltage can be removed because the magnet will hold the plunger in this position (the latched position). The force applied by the magnet is greater than the opposing force applied by the spring. To unlatch the solenoid, a voltage pulse of opposite polarity is applied to the coil. The force applied by the coil and spring overcome the force of the magnet, and the plunger returns to the unlatched position.

While the solenoid is in the unlatched position, the spring and plunger press the rubber membrane against the valve seat, preventing water flow. When the solenoid is latched, the plunger is pulled away from the membrane, and the inlet water pressure forced the membrane away from the seat, and water is allowed to flow to the outlet.

Figure 4:
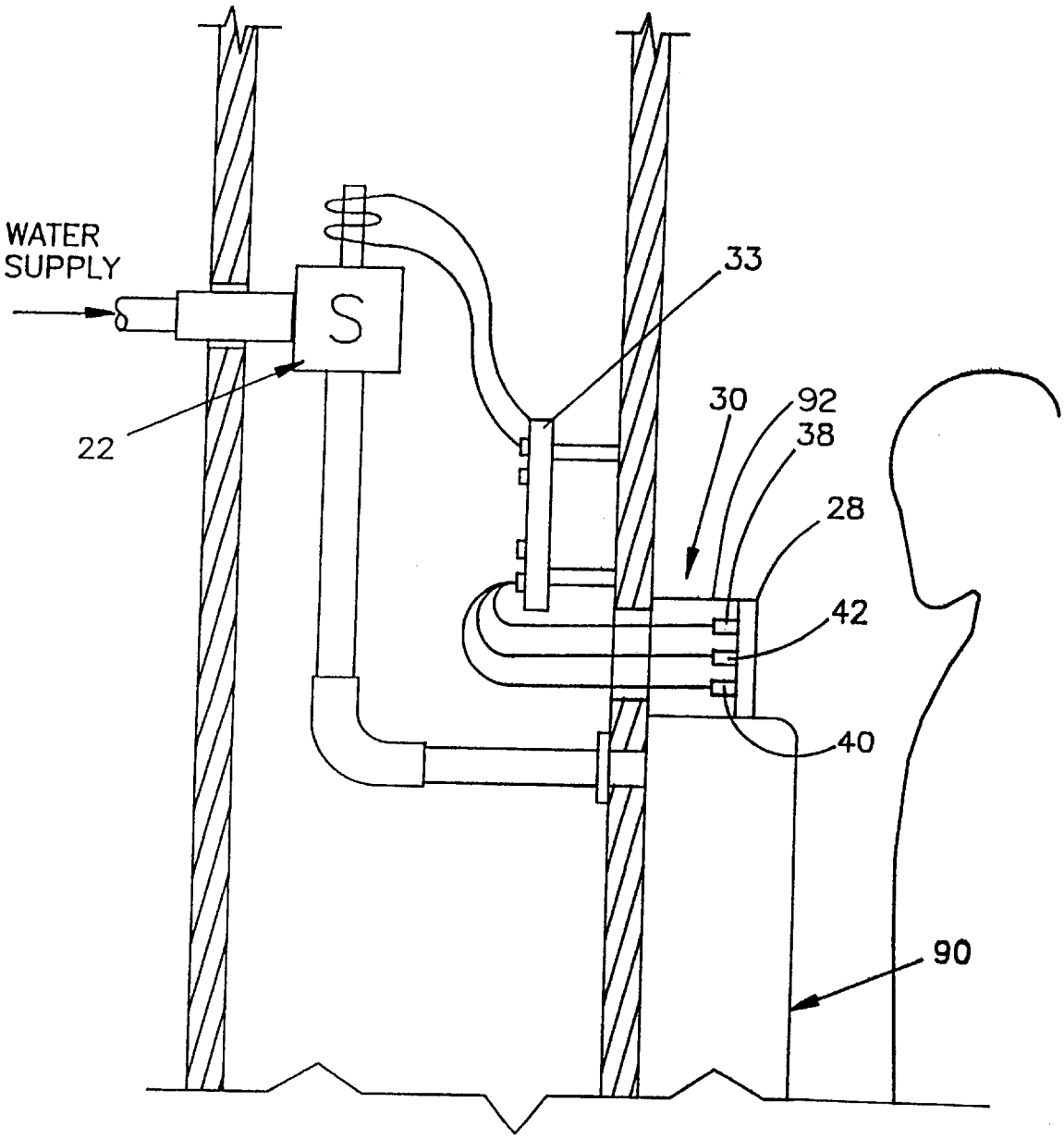
FIG. 4 is a pictorial diagrammatic illustration of the apparatus of the present invention used in conjunction with a urinal.

FIG. 4 is an elevational view of the control system of the present invention used in conjunction with a urinal. As seen in FIG. 4, urinal 90 is flow connected through solenoid valve 22 to a water supply whereby upon activation of solenoid valve 22, water is directed, through appropriate plumbing, to urinal 90. Control system 34 is provided to actuate solenoid valve 22 and is shown to be mounted on a printed circuit board 33. A housing 92 is shown mounted to the top of the urinal and encloses lens 28, infrared detector 38, infrared transmitter 40, and visible light sensor 42. Members 38, 40, and 42 are electrically connected to the control circuit 34 and mounted on circuit board 33 as shown in FIG. 3.

Figure 5:
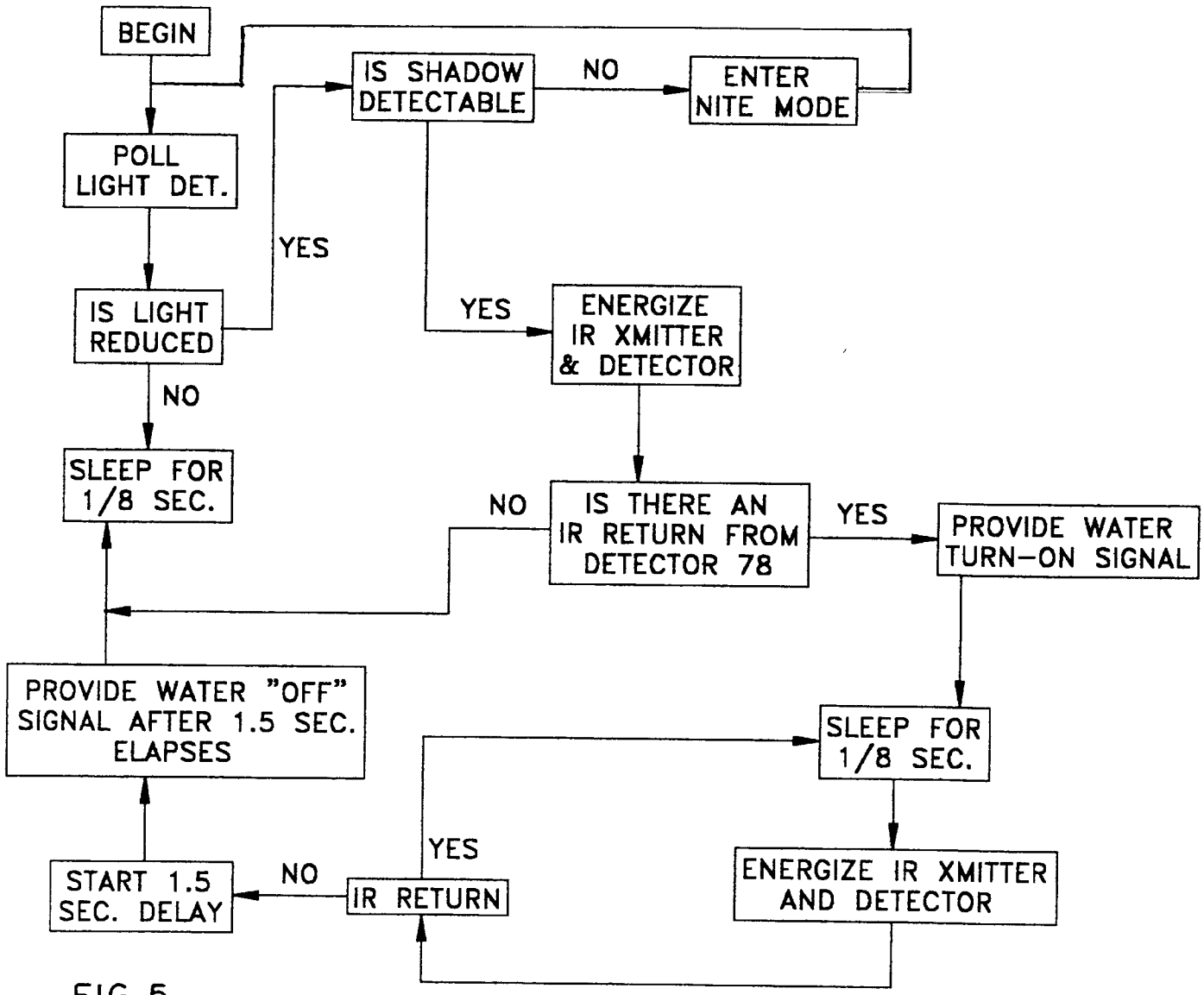
FIG. 5 is a flow chart of an operation sequence of a control system for automatically controlling water flow to a faucet.

FIG. 5 is a flow chart of an operation sequence of a control system for automatically controlling water flow to a faucet as described above.

Figure 6:
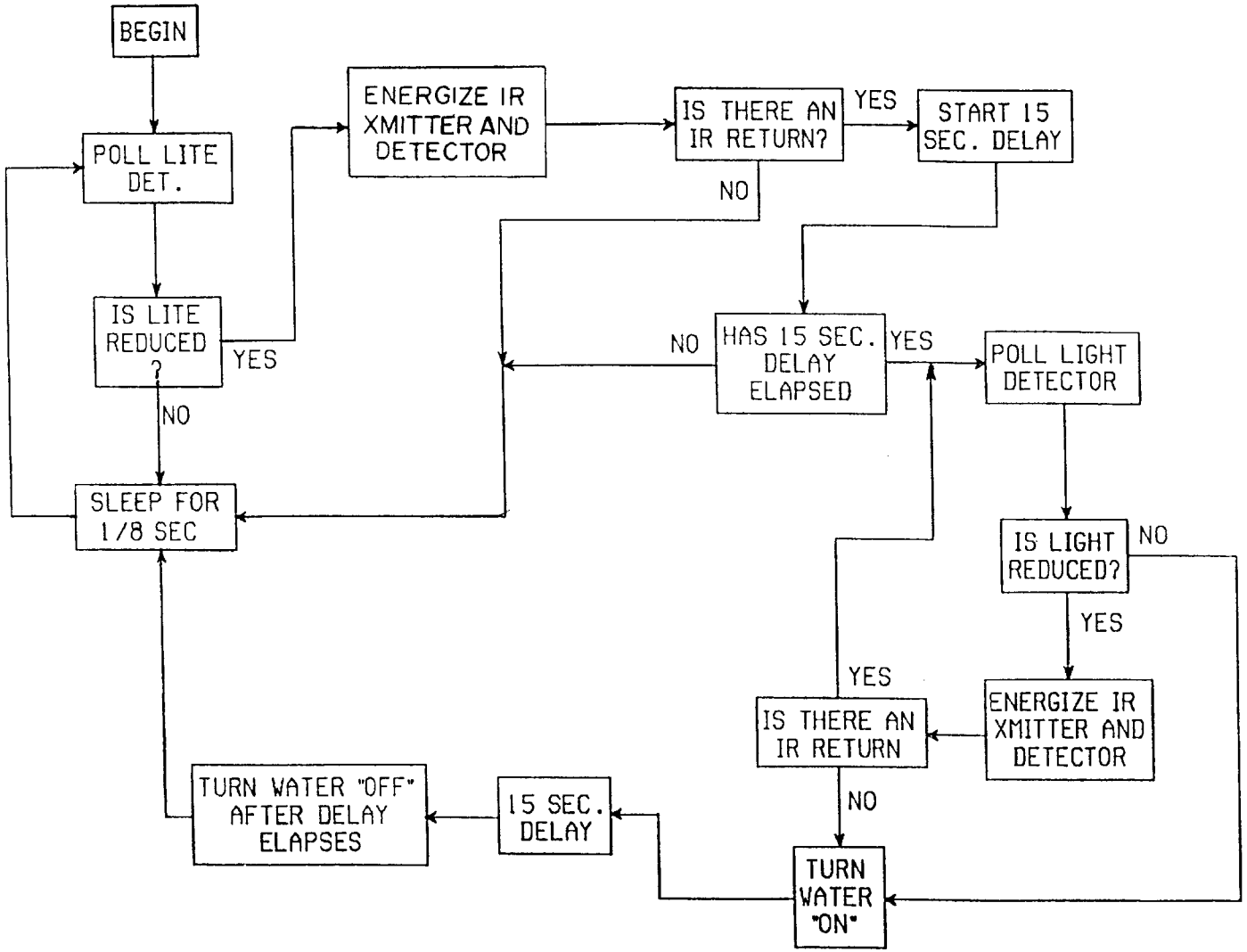
FIG. 6 is a flow chart of an operation sequence of a control system for automatically controlling water flow to a urinal.

FIG. 6 is a flow chart of an operation sequence of the control system for controlling water flow to a urinal. As seen in FIG. 6, the urinal software controls the microprocessor to make the system wait for both shadow detection and IR reflection. When both are detected, indicating a person is standing in front of the urinal, a 15-second delay timer is started. If both the shadow and IR reflection are removed during the 15-second period, the system returns to an idle state without flushing the urinal. This 15-second delay prevents flushing when people are walking by the urinal. If the shadow and IR reflection are still present after the 15-second delay, the system enters a wait mode. In this mode, the system waits for the shadow and IR reflection to be removed, indicating that the person is no longer standing in front of the urinal. When the shadow and IR reflections are removed, the solenoid is activated for 15 seconds, which flushes the urinal. The system re-enters idle mode immediately after activating the solenoid, therefore allowing another person to use the urinal before the flush cycle is finished.

It is to be understood that while the visible light sensor, the infrared transmitter, and the infrared sensor are shown to be mounted atop the urinal body, this is for illustrative purposes. Obviously, these elements may be mounted in other locations on the urinal or even in the wall adjacent to the urinal. Additionally, although FIG. 4 illustrates the printed circuit board 33 of the control circuit 34 as being remote from the light sensor, infrared transmitter, and infrared receiver, this is for illustrative purposes only. It is to be further understood that the same printed circuit board having the components of the control circuit thereon may also support the visible light sensor, the infrared transmitter, and the infrared receiver thereon.

We claim:

1. A control system for automatically controlling on-off operation of a water rinsing system including a water supply system having electrically actuated actuating means for actuation thereof to cause water flow therefrom, said on-off operation being responsive to approach and withdrawal of a user, said control system comprising:

visible light sensor means for generating an electrical current responsive to the presence of said user;

control circuit means including an infrared transmitter and an infrared receiver energized by said electrical current from said visible light sensor means for providing proximity signals indicating close proximity of said user to said water rinsing system, and microcontroller means for effecting operational control of said system, said transmitter being disposed for transmitting infrared energy for reflection by a user to said infrared receiver to provide electric signals to said microcontroller means for operational control of said electrically actuated actuation means.

2. A control system as in claim 1 wherein said visible light intensity sensor means is a photocell disposed to detect a shadow of said object proximate to said water rinsing device, thereby activating said infrared sensor means.

3. A control system as in claim 2 wherein said water rinsing device is a faucet.

4. A control system as in claim 2 wherein said water rinsing device is a urinal.

5. A control system as in claim 4 including means for delaying the energization of said electrically actuated actuation means until the presence of said object is removed from said water rinsing device.

6. A control system as in claim 1 wherein said electrically actuated actuation means includes a latching solenoid valve and solenoid valve activating means for electrically energizing said solenoid valve to control water flow therethrough.

7. A control system for automatically controlling on-off operation of a battery-driven water rinsing system including a water supply system having electrically actuated actuating means for actuation thereof to cause water flow therefrom, said on-off operation being responsive to approach and withdrawal of a user, said control system comprising:

visible light sensor means for generating an electrical current responsive to the presence of said user;

control circuit means including an infrared transmitter and an infrared receiver energized by said electrical current from said visible light sensor means for providing proximity signals indicating close proximity of said user to said water rinsing system, and microcontroller means for effecting operational control of said system, said transmitter being disposed for transmitting infrared energy for reflection by a user to said infrared receiver to provide electric signals to said microcontroller means for operational control of said electrically actuated actuating means, said microcontroller means further including a first, active mode of operation wherein said visible light sensor is polled to detect said presence of said user, and a second, power conserving stop mode wherein said microcontroller means is essentially inactive, said stop mode being activated after each polling of said visible light sensor; and means for switching said microcontroller means between said power conserving stop mode and said active mode of operation.

8. A control system as set forth in claim 7 wherein said water rinsing system is a faucet, and said water supply system provides water to said faucet, and said microcontroller means maintains flow of water responsive to said infrared receiver detecting the presence of said object and terminates said flow of water when said presence of said object is no longer detected.

9. A control system as set forth in claim 7 wherein said water rinsing system is a urinal, and said water supply provides water to said urinal, said microcontroller means initiating said flow of water for a predetermined time after said object is no longer detected at said urinal.

10. A control system as set forth in claim 7 wherein when a light intensity level falls below a level adequate for detecting the approach of said user, said microcontroller means is deactivated until said light intensity increases to said level adequate for detecting the approach of said user.

11. A method of automatically controlling on-off operation of a water rinsing device including a water discharge device having an electrically controlled valve which is automatically actuated at predetermined times and control circuit means including a microcontroller having an active processing mode and a power conserving mode, said control circuit means further including a visible light sensor to detect an object in substantial proximity to said water rinsing device, and a paired infrared transmitter and receiver operating to detect said object in close proximity to said water rinsing device for actuation of said electrically controlled valve, said method comprising the steps of:

(1) polling said visible light sensor for an indication of said object being substantially proximate to said water rinsing device and if said object is not substantially proximate to said water rinsing device;

(2) placing said microcontroller in said power conserving mode for a predetermined interval before again polling said visible light sensor and if said object is detected substantially proximate to said water rinsing device by said visible light sensor;

(3) generating an electrical current responsive to the presence of said object in substantial proximity of said water discharge device, said electrical current disposed for actuating said paired infrared transmitter and receiver to detect said object closely proximate to said water rinsing device;

(4) testing the receiver of said paired infrared transmitter and receiver at said predetermined intervals, detecting and monitoring the presence or absence of said object in close proximity of said water discharge device responsive to actuation by said electrical current of said paired infrared transmitter and receiver;

(5) energizing said electrically actuated valve to control water flow therethrough at said predetermined times responsive to the detection of the presence of said object in close proximity of said water rinsing device by said infrared receiver; and (6) deenergizing said electrically actuated valve subsequent to detection of removal of the presence of said object from said water rinsing device, said deenergization being responsive to removal of the presence of said object from said water rinsing device.

12. The method of claim 11 including the step of delaying the energization of said electrically activated control valve until the presence of said object is removed from the vicinity of said water rinsing device.

13. A method as set forth in claim 11 wherein step (4) thereof further comprises the step of placing said microcontroller in said power conserving mode between said predetermined intervals of said testing of said receiver.

14. A method as set forth in claim 13 wherein a light intensity level falls below a level adequate for detecting the presence of said object by said visible light sensor, said microcontroller being deactivated until said light intensity increases to said level adequate for detecting the presence of said object.

15. A method for controlling water flow in a faucet responsive to hands of a user moving thereunder and comprising the steps of:

(1) testing, at predetermined intervals, visible light sensor means for sensing the approach of said user to said faucet;

(2) initiating operation of means for sensing said hands of said user moving to receive water from said faucet responsive to a sensed approach of said user;

(3) testing said means for sensing said hands for a condition of said hands being positioned to receive said flow of water;

(4) initiating said flow of water responsive to sensed said hands being positioned to receive said flow of water;

(5) terminating said flow of water responsive to said means for sensing said hands detecting movement of said hands away from said faucet; and (6) placing said means for sensing said hands in a stop mode to conserve power responsive to terminating said flow water.

16. A method as set forth in claim 15 further comprising the step of disabling said means for sensing said hands to conserve power when an ambient light level falls below a level effective for sensing said approach of said user by said visible light sensor means.

* * * * *